US008773023B2

(12) United States Patent
Ghanem et al.

(10) Patent No.: US 8,773,023 B2
(45) Date of Patent: Jul. 8, 2014

(54) LED TRAFFIC SIGNAL WITH SYNCHRONIZED POWER PULSE CIRCUIT

(75) Inventors: Mohamed Cherif Ghanem, Lachine (CA); Sebastien Magnan, Lachine (CA); Christian Poirier, Lachine (CA)

(73) Assignee: GE Lighting Solutions, LLC, Cleveland, OH (US)

( * ) Notice: Subject to any disclaimer, the term of this patent is extended or adjusted under 35 U.S.C. 154(b) by 53 days.

(21) Appl. No.: 13/531,956

(22) Filed: Jun. 25, 2012

(65) Prior Publication Data

US 2012/0262077 A1 Oct. 18, 2012

Related U.S. Application Data

(63) Continuation of application No. 12/542,098, filed on Aug. 17, 2009, now Pat. No. 8,294,371.

(51) Int. Cl.
*H05B 37/02* (2006.01)

(52) U.S. Cl.
USPC ..... 315/119; 315/129; 315/287; 362/249; 362/235

(58) Field of Classification Search
USPC ..... 315/119, 129, 287, 291, 307; 362/235, 362/249, 326, 545, 800
See application file for complete search history.

(56) References Cited

U.S. PATENT DOCUMENTS

| | | | | |
|---|---|---|---|---|
| 5,457,450 | A * | 10/1995 | Deese et al. | 340/912 |
| 6,091,614 | A | 7/2000 | Malenfant | |
| 6,285,139 | B1 | 9/2001 | Ghanem | |
| 6,310,445 | B1 | 10/2001 | Kashaninejad | |
| 7,057,529 | B2 * | 6/2006 | Bourgault | 340/907 |
| 7,333,027 | B2 | 2/2008 | Bourgault | |
| 7,425,798 | B2 | 9/2008 | St.-Germain | |
| 7,490,954 | B2 * | 2/2009 | Mayer et al. | 362/235 |
| 7,701,150 | B2 | 4/2010 | Nguyen et al. | |
| 7,855,660 | B2 * | 12/2010 | Kim et al. | 340/925 |
| 2002/0134999 | A1 | 9/2002 | Hirokawa et al. | |
| 2005/0063182 | A1 * | 3/2005 | Birch et al. | 362/249 |
| 2008/0218097 | A1 | 9/2008 | Housman | |
| 2009/0167186 | A1 | 7/2009 | Ghanem | |
| 2009/0237928 | A1 * | 9/2009 | Dubuc | 362/235 |

FOREIGN PATENT DOCUMENTS

| | | |
|---|---|---|
| EP | 1 368 997 | 1/2006 |
| GB | 2 371 689 | 7/2002 |
| GB | 2 429 542 | 2/2007 |
| WO | WO 02/074017 | 9/2002 |

* cited by examiner

*Primary Examiner* — Vibol Tan

(74) *Attorney, Agent, or Firm* — Fay Sharpe LLP

(57) ABSTRACT

An improved LED traffic signal is provided. The LED traffic signal suitably includes a housing with an opening, a printed circuit board coupled to the housing, and a power supply system coupled to the printed circuit board. The power supply system includes a power supply module that receives an AC input voltage from an AC input line and transforms the AC input voltage into a DC voltage with a regulated current to power the LED load, and a synchronized power pulse circuit connected to the power supply that generates a synchronized power pulse representing a power consumption substantially equivalent to that of a halogen or incandescent traffic signal.

20 Claims, 8 Drawing Sheets

INPUT FREQUENCY DETECTION CIRCUIT

INPUT FREQUENCY TO VOLTAGE CONVERTER Vref = f (Fin)

SYNCHRONIZED PULSE WIDTH GENERATOR CIRCUIT

POWER PULSE CIRCUIT

LED TRAFFIC SIGNAL WITH SYNCHRONIZED POWER PULSE CIRCUIT

This application is a continuation of U.S. patent application Ser. No. 12/542,098, filed Aug. 17, 2009 now U.S. Pat. No. 8,294,371 and incorporated herein by reference in its entirety.

FIELD OF THE INVENTION

The present invention relates to traffic signals. It finds particular application in conjunction with power supplies for light emitting diode (LED) traffic signals and will be described with particular reference thereto. However, it is to be appreciated that the present invention is also amenable to other like applications.

BACKGROUND

By way of background, traffic signals are employed to regulate motorists and pedestrians via various commands. These commands are provided by various illuminated elements with particular colors and/or shapes that are each associated with an instruction. Elements were conventionally illuminated via incandescent bulbs, which use heat caused by an electrical current to emit light. When electrical current passes through a filament such as tungsten it causes the filament to heat to the point that it glows and gives off light. Such illumination can be covered with a colored lens and/or template to provide a meaningful instruction that can be viewed in a variety of external lighting conditions.

The filament is a resistive element in the incandescent bulb circuit, and the amount of current drawn by the filament is proportional to its impedance. The impedance increases as the temperature of the filament increases. Thus, a conventional lamp has a larger initial current draw, which drops in proportion to the increase in the filament impedance. This variation in current draw is known, and a predetermined range can be utilized to monitor the lamp operation. As such, a lamp failure condition can be identified based on the amount of current drawn by the filament. For example, if the filament fails (e.g., breaks), the impedance approaches an infinite value and the current value decreases to almost zero. If the current drawn is outside of the predetermined range, a responsive action can be initiated by a current monitor or other control system.

Unlike incandescent lamps, LED lamps consist of an array of LED elements that draw much less power. LED lamps have numerous advantages over incandescent lamps, including greater energy efficiency and a longer lifetime between replacements.

An LED traffic signal generally includes a standard power supply that incorporates a safety circuit. In cooperation with the safety circuit, the LED traffic signal includes an LED current detector that generates a light output emission signal. When appropriate, this signal causes a fuse to blow out within the power supply, which in turn causes an input fuse to blow. As a result, there will be no input current to the LED signal if the LED current drops below a pre-determined LED current level.

Existing traffic controllers, however, were designed for incandescent lamps, which consume between 30 and 100 watts of power. Thus, the safety circuit in the lamp forces a fuse to blow out when the power drawn by the load is lower than a predetermined threshold (for example, 30 watts). However, LEDs generally consume less power than incandescent lamps, usually less than 10 watts. Thus, at 10 watts the traffic controller may fail to work.

One known solution is to increase the power consumption of the LEDs by more than 30 watts. However, this creates thermal issues in the traffic signal and accelerates LED degradation. Another known solution is to modify the input current by adding a special circuit in parallel with the LEDs that emulates higher power consumption. This solution, however, requires a circuit external to the LED signal, wastes energy and introduces false alarms to the field traffic controller. When the input frequency line varies, the emulated higher power consumption changes the angle position and then the controller cannot read it.

Thus, there is a need for an apparatus and method that eliminates the above-discussed drawbacks of the prior art.

BRIEF DESCRIPTION

A typical LED traffic signal includes a power supply that incorporates a safety circuit. The LED traffic signal also includes an LED current detector that effectively measures the light output emission signal. A new synchronized power pulse circuit senses the input line frequency, calculates a corresponding phase angle after measuring the input frequency, and activates a power pulse between the calculated phase angles t1 and t2. The calculated phase angles are variables, and they are a function of the input line frequency. The power pulse magnitude is a function of the input line frequency, the switching duty cycle, and the magnitude of the input supply voltage. The new synchronized power pulse circuit provides a current pulse that is in phase with the calculated phase angles. The current sink introduced by the synchronized power pulse circuit increases the overall electrical current consumed by the LED traffic signal by only a small amount (e.g., 5 watts). However, this small additional power draw may be seen as 50 watts by the external field controller, thereby indicating to the field controller that the traffic signal is working properly.

In accordance with one aspect of the present invention, a power supply system for providing power to an LED traffic signal is provided. The power supply system includes an LED load, a power supply module that receives an AC input voltage from an AC input line and transforms the AC input voltage into a DC voltage with a regulated current to power the LED load, and a synchronized power pulse circuit connected to the power supply that generates a synchronized power pulse representing a power consumption substantially equivalent to that of a halogen or incandescent traffic signal.

In accordance with another aspect of the present invention, an LED traffic signal is provided. The LED traffic signal includes a housing with an opening, a printed circuit board coupled to the housing, and a power supply system coupled to the printed circuit board. The power supply system includes a power supply module that receives an AC input voltage from an AC input line and transforms the AC input voltage into a DC voltage with a regulated current to power the LED load, and a synchronized power pulse circuit connected to the power supply that generates a synchronized power pulse representing a power consumption substantially equivalent to that of a halogen or incandescent traffic signal.

In accordance with yet another aspect of the present invention, a calculated phase angle circuit for an LED traffic signal is provided. The circuit comprises a line frequency detector circuit module that detects the frequency of an AC input line having an input line voltage and generates a synchronized wave signal, a gate command pulse generator circuit that maintains a gate width in phase with the input line voltage and maintains the gate width with respect to the input line sine wave voltage, and a phase angle circuit that maintains a turn on time and a turn off time of the gate width at the same phases within the line voltage sine wave independently of the input frequency variation.

In accordance with yet another aspect of the present invention, an LED current detector and safety circuit for an LED traffic signal is provided. The LED current detector and safety circuit comprises an LED current monitor circuit that verifies the normal operation and light output of an LED load and a safety circuit that monitors the normal operation of LED light output, wherein the safety circuit is operative to disable an LED power supply and a synchronized power pulse circuit if the LED current fails to be equal to or greater than a predetermined LED current level.

BRIEF DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

DETAILED DESCRIPTION

Figure 1:
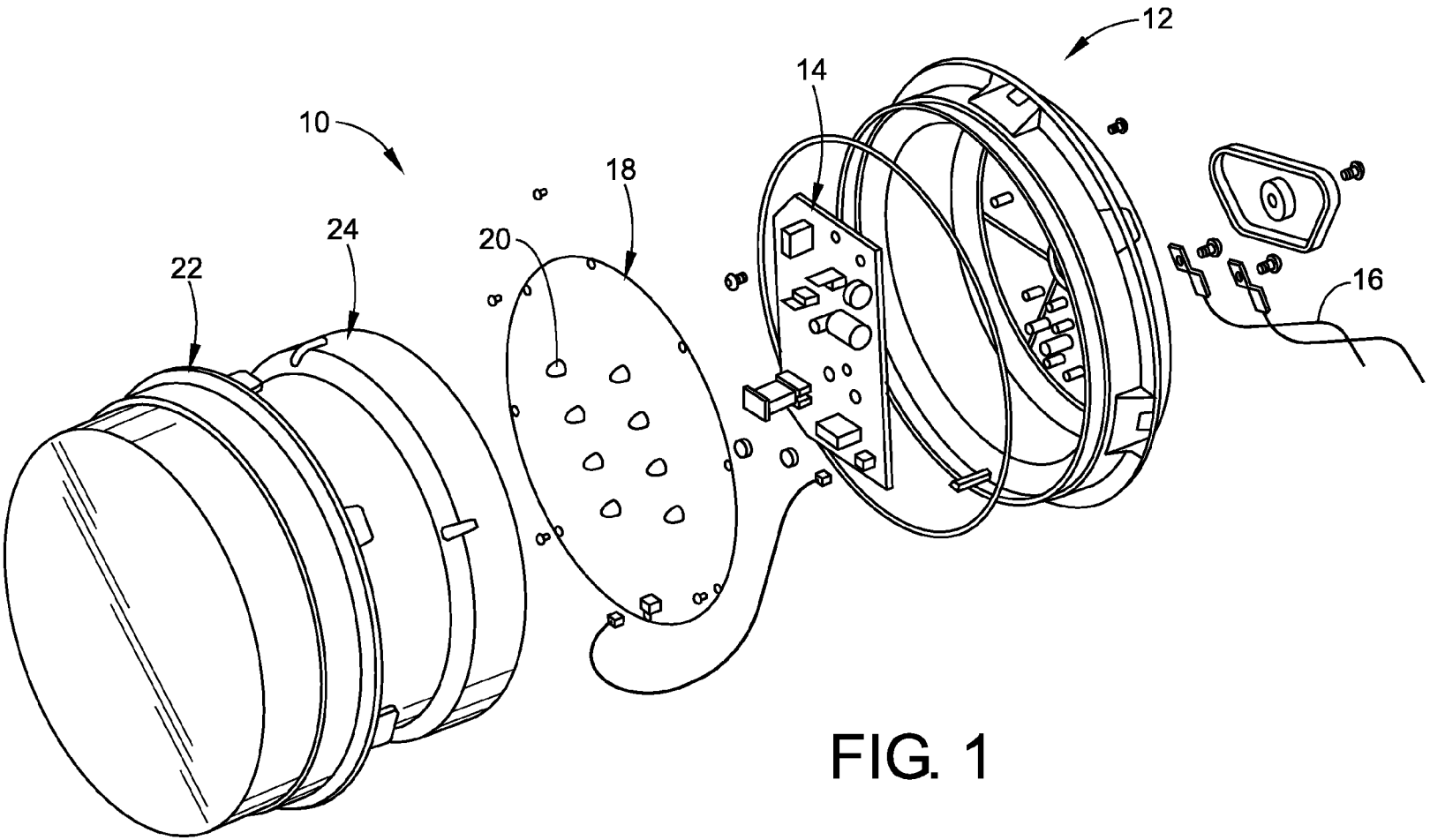
FIG. 1 shows an exemplary LED traffic signal.

Referring now to the drawings wherein the showings are for purposes of illustrating the exemplary embodiments only and not for purposes of limiting the claimed subject matter, FIG. 1 shows an exemplary LED traffic signal 10 that generally includes a housing 12, an LED power supply 14, at least a pair of wires 16, a printed circuit board 18, at least one LED 20, and an outer shell or cover 22. In addition, the LED traffic signal 10 may include a mask (not shown) and/or an optical element 24. For example, an arrow traffic signal preferably uses an arrow shaped mask (not shown). The housing 12 is typically moisture and dust resistant. Preferably, the optical element 24 and the outer shell 22 are made of UV stabilized polycarbonate.

Figure 2:
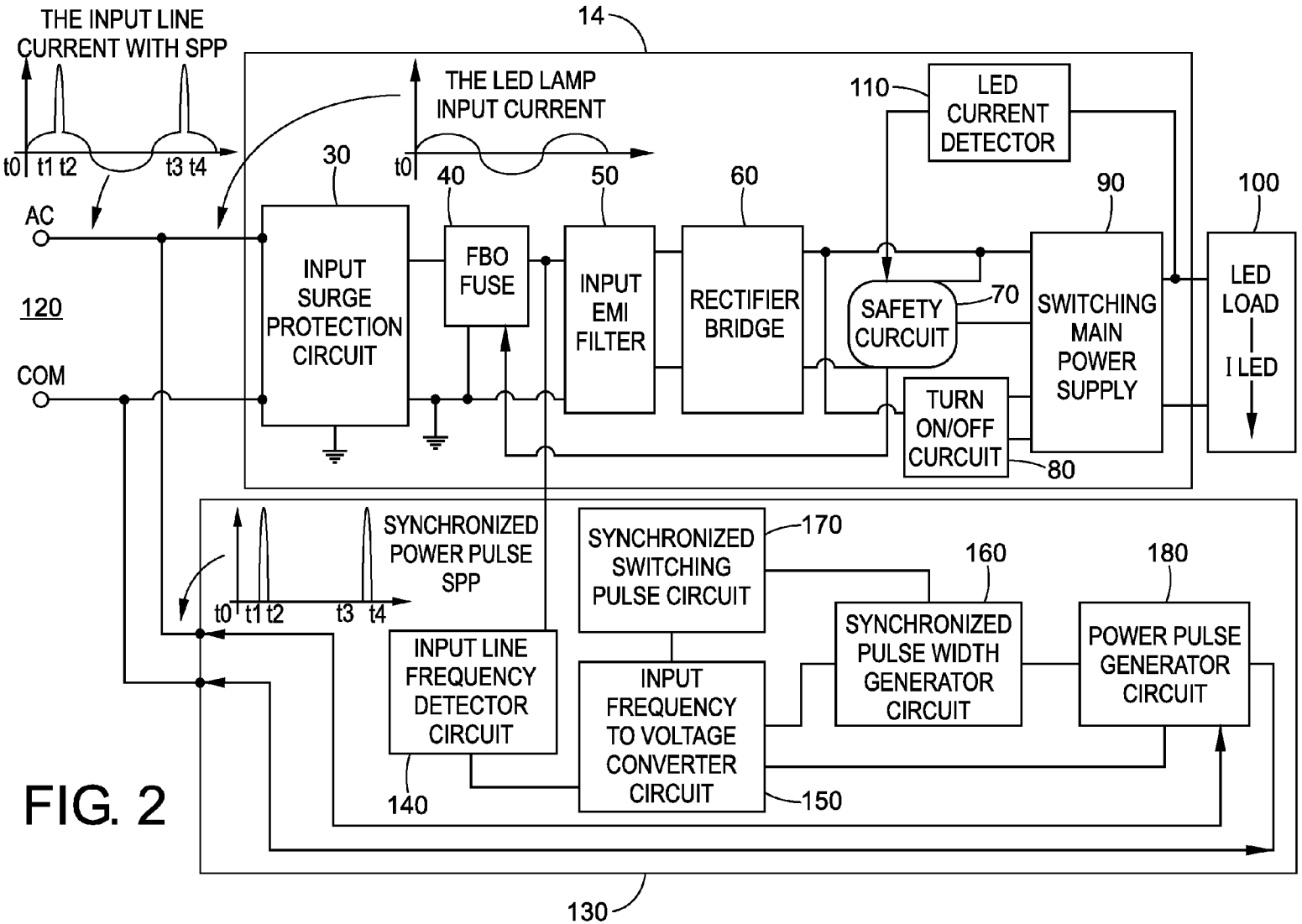
FIG. 2 is a block diagram showing the basic components of the LED traffic signal in accordance with aspects of the present invention.

A block diagram of the LED power supply 14 is shown in FIG. 2. The LED power supply 14 generally comprises the following components: an input surge protection circuit 30, a fuse blow out (FBO) circuit 40, an input EMI filter 50, a rectifier bridge 60, a safety circuit 70, a turn on/turn off circuit 80, and a switching main power supply 90. The LED power supply 14 is suitably connected to an LED load 100 and to an LED current detector circuit 110. Further, in furtherance of adapting the LED traffic signal 10 to the existing traffic controllers, a new synchronized power pulse circuit 130 has been added. The synchronized power pulse circuit 130 forms part of the power supply 14, which is located inside the back housing 12 of the LED traffic signal 10. The synchronized power pulse circuit 130 suitably comprises at least the following components: an input line frequency detector circuit 140, an input frequency to voltage converter circuit 150, a synchronized pulse width circuit 160, a synchronized switching pulse circuit 170 and a power pulse circuit 180. The external field controller (not shown) connects directly to the traffic signal 10 through the wires 16 (AC and COM in FIG. 2). Each component in the LED power supply 14 will be described in greater detail below.

The input EMI filter 50 typically receives and filters line power that is ultimately delivered to the LED load 100. In this manner, the LED power supply 14 is protected against internal overload and/or a line voltage surge. The input EMI filter 50 suitably filters the switching frequency of the power stage input current in order to meet the EN55022 conducted and radiated Class B EMC. Optionally, the input surge protection circuit 30 can provide protection against overload greater than a predetermined level (e.g., 3.5 A) due to line surge.

Current is drawn from the input EMI filter 50 by the rectifier bridge 60 and then supplied to the LED load 100 through the switching main power supply 90. The main switching power supply 90 takes the AC voltage from the AC input line 120, through the input surge protection circuit 30, the FBO circuit 40, the input EMI filter 50 and the rectifier bridge 60, and transforms it into DC voltage, with a regulated current, to power the LED load 100. As shown in FIG. 2, the switching main power supply 90 is connected to one output leg of the rectifier bridge 60, one output line of the safety circuit and two output lines of the turn on/turn off circuit 80. The switching main power supply 90 thus provides a regulated current to power the LED load 100. The switching main power supply 90 supplies current to the LED load 100 when the input voltage is within a specific range (i.e., dimming range voltage or full light range voltage). The dimming range can be between 20% and 50% of the full light. In this manner, the LED load 100 can be employed to emit continuous light with no flicker. A flyback converter topology can be employed to provide specific voltage across the LED load 100 based on a desired LED configuration. Such configurations can vary based on the quantity and/or type of LED employed.

The LED load 100 typically comprises a plurality of LEDs mounted in series and in parallel on a printed circuit board. If an LED suffers from a catastrophic failure, only the affected LED will shut down. The current will be equally spread among the remaining LEDs. As a result, the remaining LEDs and, thus, the lamp 10 will remain lit. It is to be appreciated that the extra current will not damage the remaining LEDs since the LEDs are well de-rated.

As stated above, the LED power supply 14 can include a safety circuit 70 and an LED current detector circuit 110 that monitors the current drawn by the LED load 100 and turns off permanently a switch (not shown) by blowing an FBO fuse in the FBO circuit 40 when the LED current is typically below twenty percent of its nominal value. The current flowing in the LED load 100 may be regulated by a current sense feedback component (not shown) to provide constant light flux.

Thus, if the current falls below a certain level for a specified length of time and within the specified operated input voltage, that is, at a time the lamp should be lit, the FBO circuit 40 is activated. The FBO circuit 40 uses a high power MOSFET to make a short between the active and neutral wire of the LED traffic signal 10, thereby melting a fuse. The FBO circuit 40 is an active circuit whose role is to intentionally blow the input fuse upon sensing a lack of LED current to allow detection of the failed lamp by a remote system designed to monitor signals for incandescent lamps. The whole cycle (from detection and activation to fuse melting) takes less than a second.

The safety circuit 70 blows out a fuse to disable the power supply 90 and the synchronized power pulse circuit 130 if no current flows through the LED load 100 after a predetermined time when the input line is activated and/or the light out detection circuit 110 detects less than a predetermined threshold light output. The synchronized power pulse circuit 130 creates synchronized power consumption to the line voltage waveform. This power consumption has a calculated pulse width time, which is synchronized to the AC line voltage waveform. The pulse width time calculation is variable, that is, it is a function of the input frequency of the AC line voltage waveform. The synchronized power pulse has a fixed phase angle with respect to the line voltage, independent of the input AC line frequency. This power pulse width is synchronized and centralized to the input sine wave voltage. The position of the power pulse versus the input voltage sine wave is at all times at the same angle, independent of the input frequency variation. The angle can be expressed as: Phase 1 ($\Phi 1$) $=\omega * t_1=2\pi * f * t_1$ or Phase 2 ($\Phi 2$)$=\omega * t_2=2\pi * f * t_2$.

This synchronized power pulse can be switched in high frequency and with a certain duty cycle. This permits the external traffic controller to see the LED current signal $I_L$ operating as a high power consumption signal, but in reality, the synchronized power pulse consumes a very small amount of power under all conditions. The LED traffic signal 10 (through the AC and COM connection) enables the synchronized power pulse circuit 130 once the "light out" turns on. That is, the safety circuit 70 of the LED traffic signal 10 will disable the LED power supply 14 and the synchronized power pulse circuit 130 upon a "light out" condition, if the LED load 100, and then the LED traffic signal 10, fail. A "light out" condition is detected by the LED current detector circuit 110. In this manner safety will be maintained and the external traffic signal controller will quickly detect the signal failure.

We turn now to FIGS. 3-7, which are detailed schematic diagrams of the five components (140, 150, 160, 170, and 180) that generally comprise the new synchronized power pulse circuit 130.

Figure 3:
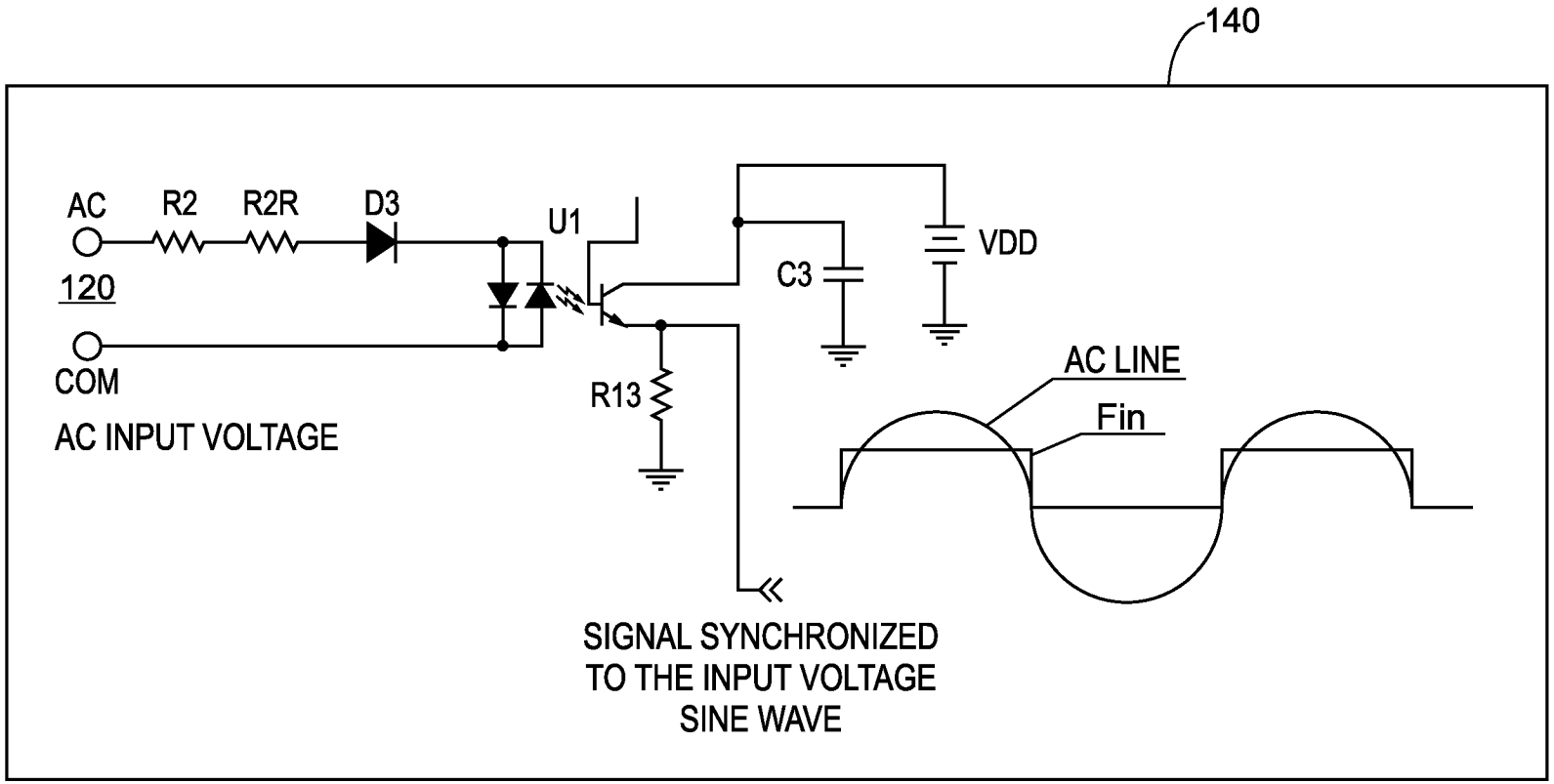
FIG. 3 is a schematic diagram of an input frequency detection circuit.

FIG. 3 is a schematic diagram of the input line frequency detector circuit 140. This circuit suitably detects the frequency of the AC input line 120 and generates a square wave signal $F_{in}$. This square wave signal $F_{in}$ is then synchronized to the AC input line voltage waveform by the input line frequency detector circuit 140.

Figure 4:
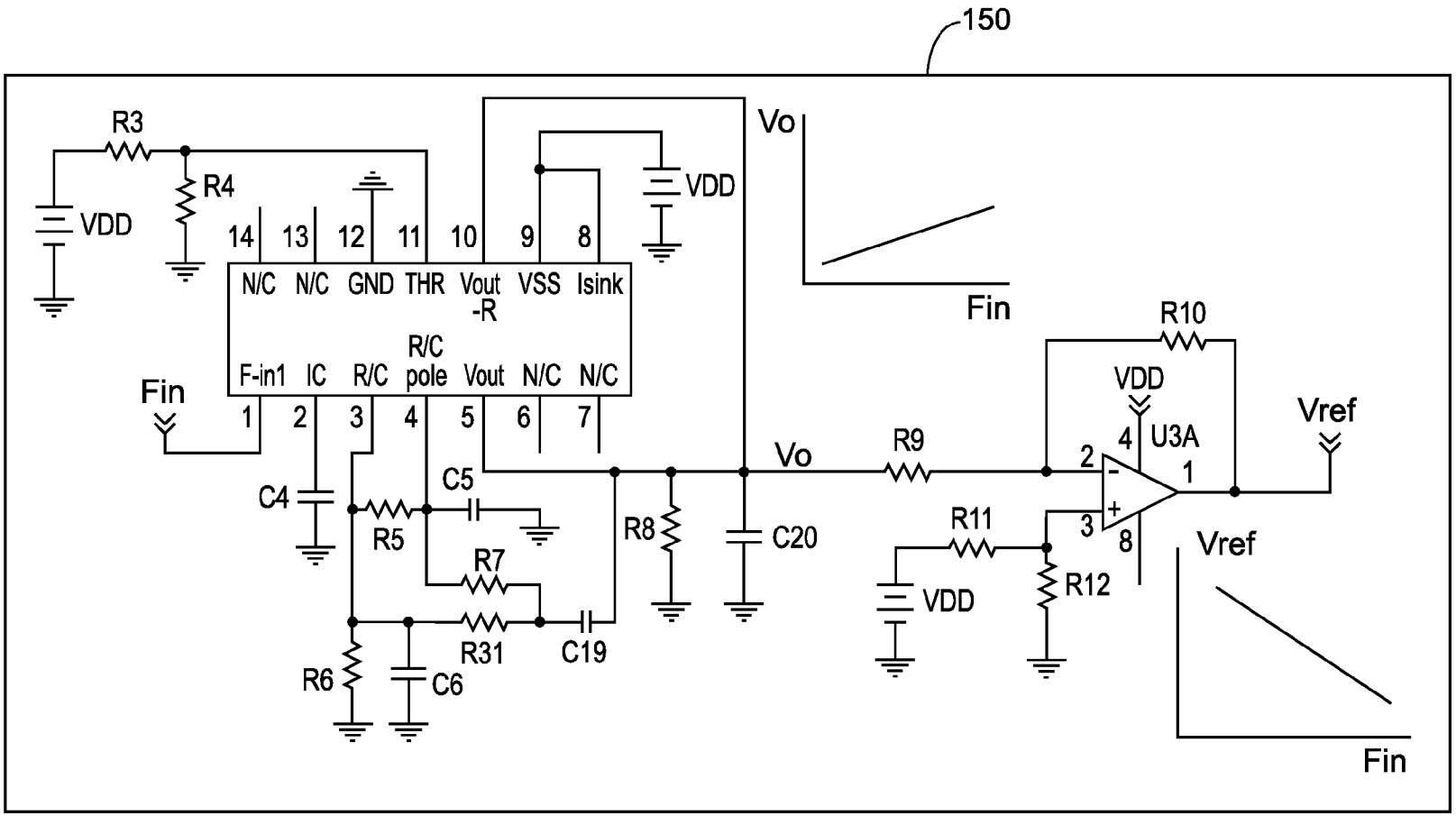
FIG. 4 is a schematic diagram of an input frequency to voltage converter circuit.

FIG. 4 is a schematic diagram of the input frequency to voltage converter circuit 150. This circuit converts the synchronized square wave signal $F_{in}$ generated by the input line frequency detector circuit 140 to a voltage $V_o$. The voltage $V_o$ may be represented by the following equation:

$$V_o=K1*VDD*F_{in} \tag{1}$$

where:

K1=constant

VDD=Supply Voltage $F_{in}$=Input frequency

The voltage $V_o$ is then converted to $V_{ref}$ through signal conditioning. More particularly, $V_{ref}$ may be represented by the following equation:

$$V_{ref}=K2*(K3*VDD-V_o) \tag{2}$$

where:

K2=constant

K3=constant

Figure 5:
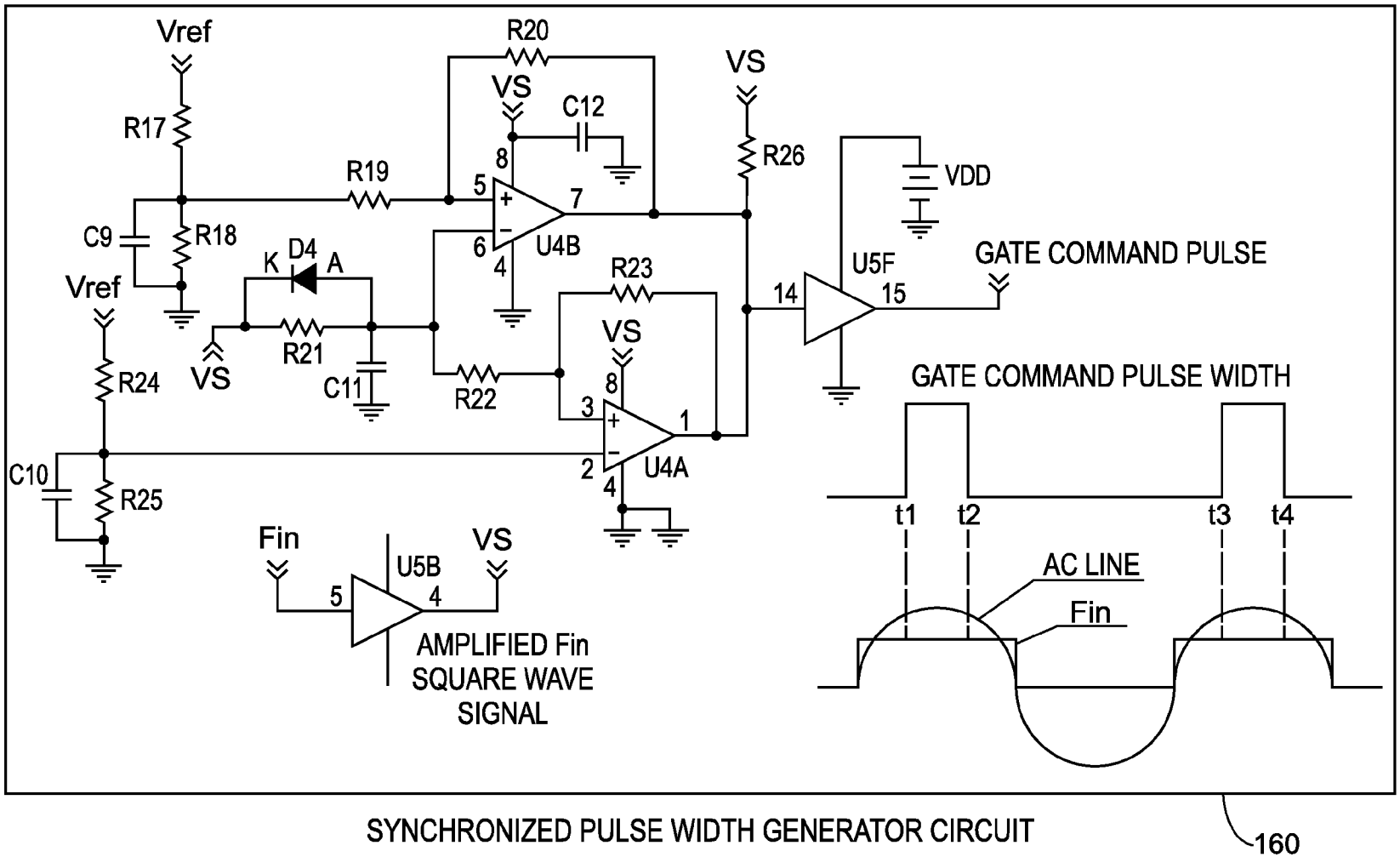
FIG. 5 is a schematic diagram of a synchronized pulse width generator circuit.

FIG. 5 is a schematic diagram of the synchronized pulse width generator circuit 160. This circuit generates a gate command pulse. The gate command has a pulse width that is a function of the reference voltage $V_{ref}$, which, in turn, is a function of the frequency $F_{in}$, as defined above. Thus, the gate command pulse width (t1, t2) is a function of the frequency $F_{in}$:

$$t1=-R21*C11*In(K4*V_{ref} \tag{3}$$

$$t2=-R21*C11*In(K5*V_{ref}N_o) \tag{4}$$

where:

K4=R25/(R24+R25)

K5=R18/(R17+R18)

In this manner, the gate command pulse and then the power pulse will be synchronized and located at the same phase angle, independently of the line frequency variation. The synchronized pulse width generator circuit 160 activates a power pulse only between the measured phase angles t1 and t2 as defined above. The synchronized power pulse consumption P is defined as:

$$P=(Vac^2/Z1)*PW/F_{in} \tag{5}$$

where:

PW=pulse width=t−t1

Z1=synchronized power pulse impedance

Figure 6:
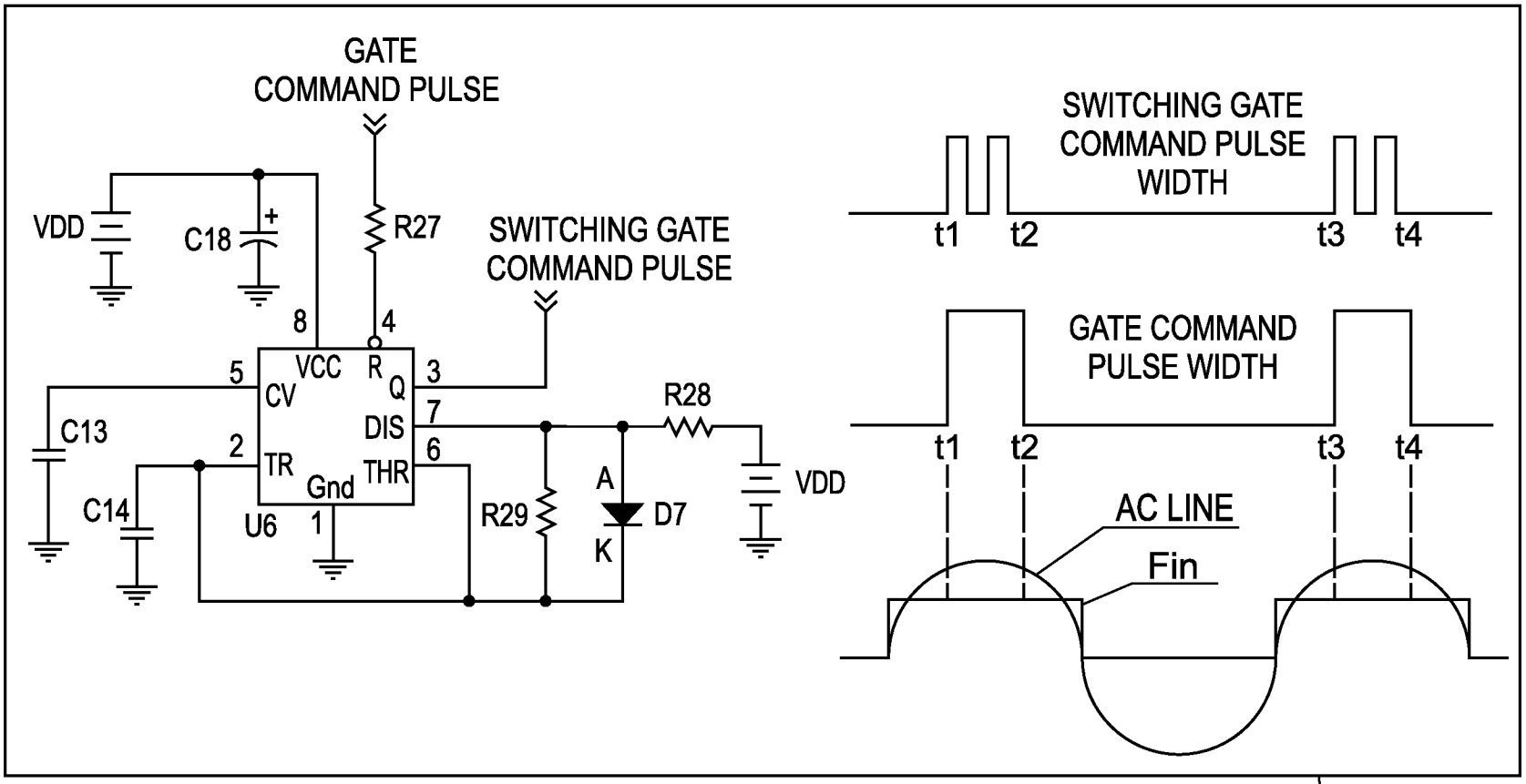
FIG. 6 is a schematic diagram of a synchronized switching pulse circuit.

FIG. 6 is a schematic diagram of the synchronized switching pulse circuit module 170, which reduces the power consumption of the power pulse by fixing the duty cycle D of the gate command. Duty cycle D varies from 0% to 100%. If D=100%, then the power consumption Ps is equal to $Ps_{max}$. If we fix D at a lower value, such as 10%, the power consumption will be 10% of $Ps_{max}$. The switching synchronized power pulse consumption Ps may be defined as:

$$Ps=(Vac^2/Z1)*D*PW/F_{in} \tag{6}$$

The switching gate command pulse is also synchronized to the input line voltage waveform. The output of FIG. 6 is the switching gate command pulse pin 3, which goes to gate Q1 in FIG. 7.

Figure 7:
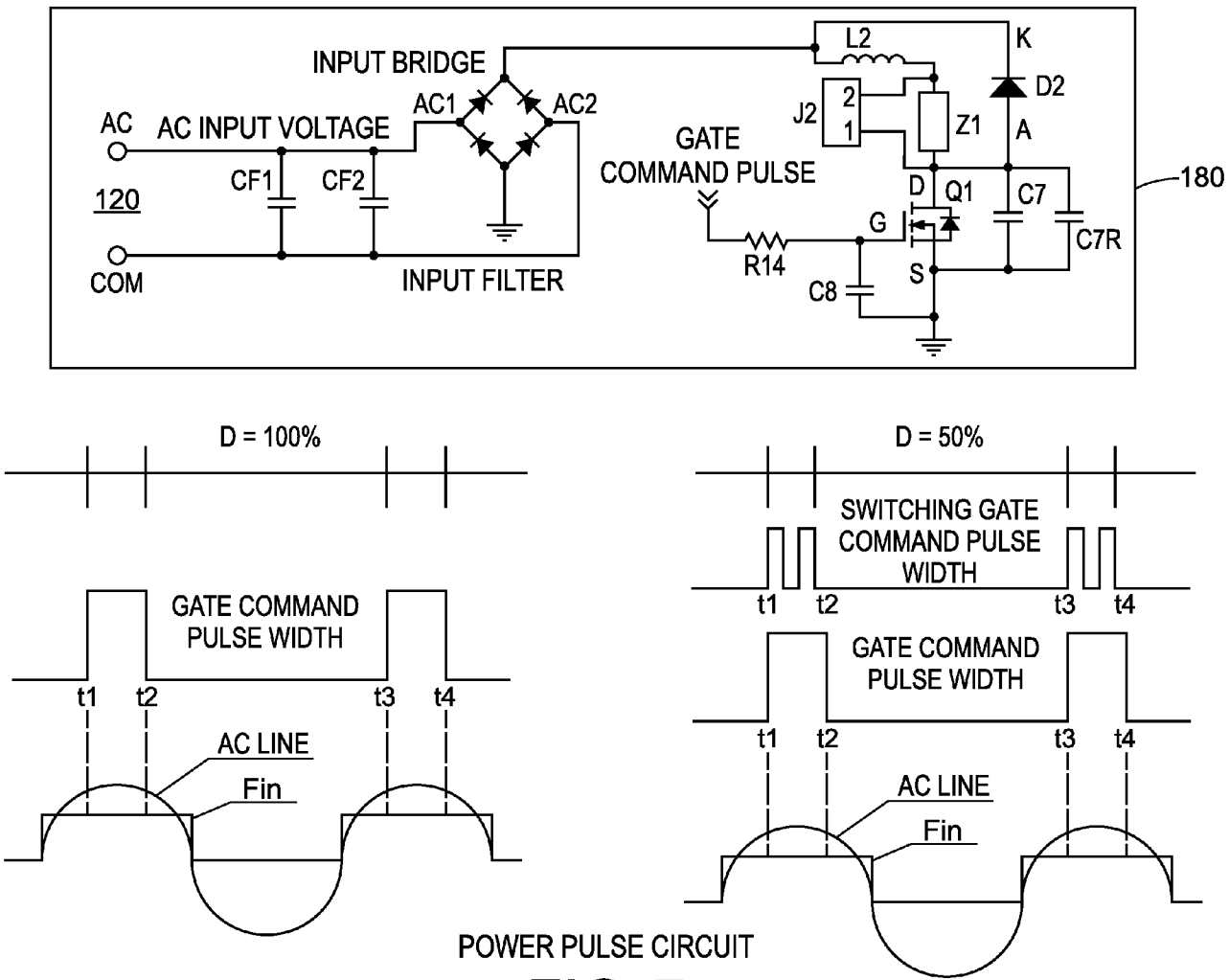
FIG. 7 is a schematic diagram of a power pulse circuit.

FIG. 7 is a schematic diagram of the power pulse circuit 180, which sinks a current pulse through an input filter (182, L2, Z1 and Q1) from the AC input line 120. The amplitude of the current pulse is a function of the input voltage level and the impedance L2-Z1. The switch Q1, which is controlled by the gate command pulse, controls the timing of the current. As described earlier, the synchronized pulse width generator circuit 160 generates the gate command pulse. The function of the input filter is to rectify the AC input voltage. The external field controller will see the power pulse generated by the power pulse circuit 180 as representing a high power consumption, substantially equivalent to that of a standard lamp (halogen or incandescent), and will thus accept the LED traffic signal 10 as being in a normal state of operation.

Figure 8:
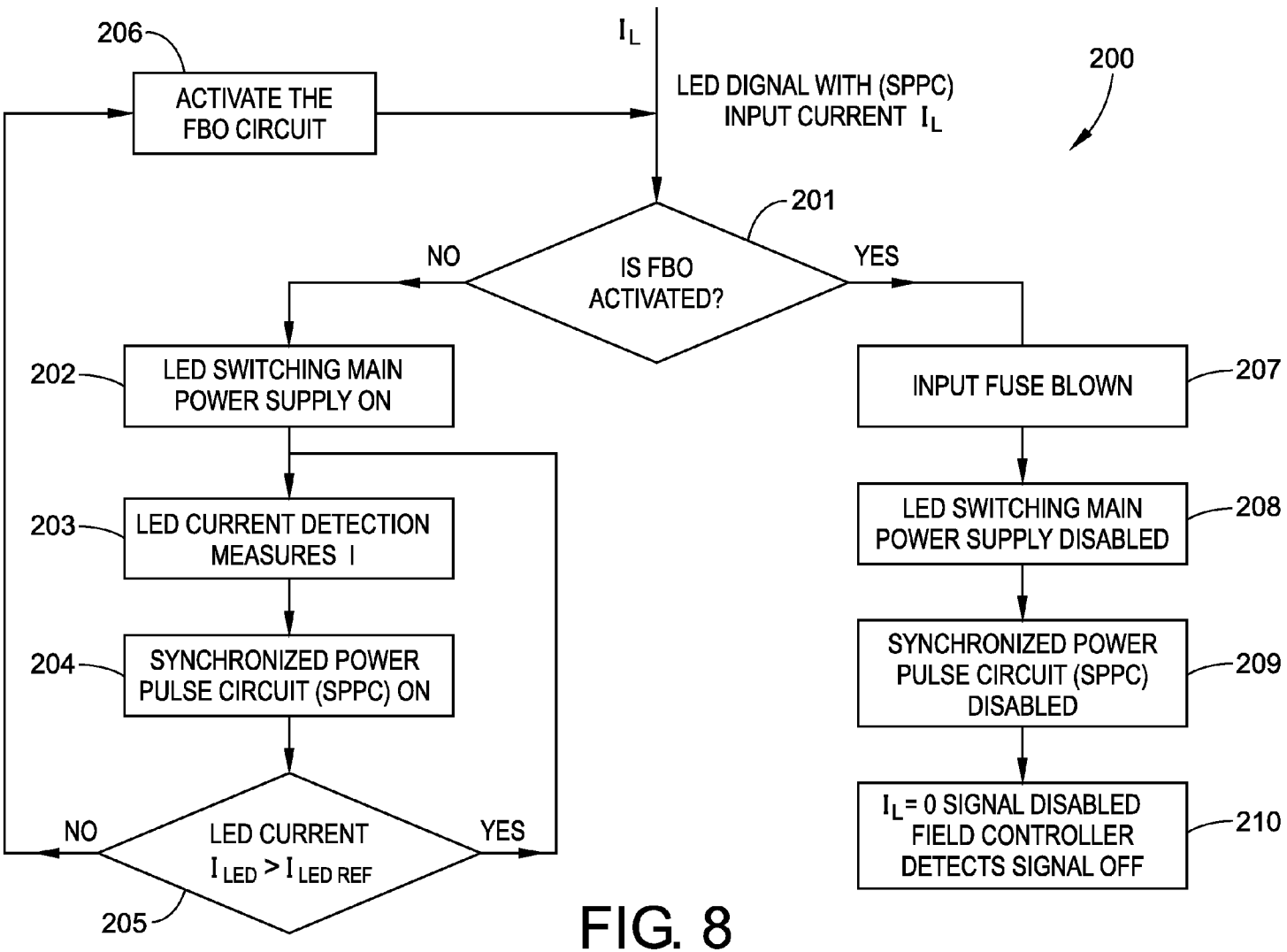
FIG. 8 is a flow diagram illustrating an exemplary mode of operation for the LED traffic signal shown in FIG. 1, in accordance with aspects of the present invention.

FIG. 8 is a flow diagram illustrating an exemplary method 200 of traffic signal operation when the synchronized power pulse circuit 130 as described above is incorporated into the traffic signal 10. Initially, a determination is made as to whether the FBO circuit 40 has been activated (201). If not, then the switching main power supply 90 is left "ON" (202). The LED current detector circuit 110 measures the DC constant current through the LEDs ($I_{LED}$) (203), and the synchronized power pulse circuit 130 is left "ON" (204). Next, the $I_{LED}$ is compared to the LED reference current $I_{LEDref}$, which is the current necessary for the LEDs to get the minimum acceptable light output. If $I_{LED}$ is greater than $I_{LEDref}$, then return to step 203. If, however, $I_{LED}$ is less than $I_{LEDref}$, then the FBO circuit 40 is activated (206).

On the other hand, if the FBO circuit 40 has been activated, then the input fuse is blown (207). Once the input fuse of the LED traffic signal 10 is blown, the total current $I_L$ will shut down and the external field controller immediately detects that the LED traffic signal 10 is "OFF." At this point, the switching main power supply 90 is disabled (208), the synchronized power pulse circuit 130 is disabled (209), and the total current sink by the LED traffic signal 10 ($I_L$) is now disabled and equal to 0. $I_L$ is the sum of two currents, one from the LED power supply 14 and the other from the synchronized power pulse circuit 130.

The above description merely provides a disclosure of particular embodiments of the invention and is not intended for the purposes of limiting the same thereto. As such, the invention is not limited to only the above-described embodiments. Rather, it is recognized that one skilled in the art could conceive alternative embodiments that fall within the scope of the invention.

The invention claimed is:

1. A power supply system o providing power to an LED traffic signal, the system comprising:

an LED load;

a power supply module that receives an AC input voltage from an AC input line and transforms the AC input voltage into a DC voltage with a regulated current to power the LED load; and a synchronized power pulse circuit connected to the power supply module that generates a power pulse synchronized to the AC input voltage and representing a power consumption substantially equivalent to that of a halogen or incandescent traffic signal.

2. The system of claim 1, wherein the synchronized power pulse has a fixed phase angle with respect to the line voltage independent of the AC line frequency.

3. The system of claim 1, wherein the power supply further comprises: an input surge protection circuit, a fuse blow out circuit, an input EMI filter, a rectifier bridge, a safety circuit, a turn on/turn off circuit, an LED current detector circuit and a switching main power supply.

4. The system of claim 1, wherein the LED load comprises at least one LED mounted on a printed circuit board.

5. The system of claim 3, wherein the fuse blow out circuit comprises a switch adapted to create a short between an active and a neutral wire of the traffic signal.

6. The system of claim 3, wherein the safety circuit is operative to blow out a fuse to disable a switch if no current flows through the LED load after a predetermined time when the switch is activated and/or the light out detector circuit detects less than a predetermined threshold light output.

7. An LED traffic signal comprising:

a housing with an opening;

a printed circuit board coupled to the housing;

a power supply coupled to the printed circuit board, the power supply comprising:

a power supply module that receives an AC input voltage from an AC input line and transforms it into DC voltage with a regulated current to power an LED load; and a synchronized power pulse circuit connected to the power supply module that generates a power pulse synchronized to the AC input voltage and representing a power consumption substantially equivalent to that of a halogen or incandescent traffic signal.

8. The LED traffic signal of claim 7, wherein the synchronized power pulse has a fixed phase angle with respect to the line voltage independent of the AC line frequency.

9. The LED traffic signal of claim 7, wherein the power supply further comprises: an input surge protection circuit, a fuse blow out circuit, an input EMI filter, a rectifier bridge, a safety circuit, a turn on/turn off circuit, an LED current detector circuit and a switching main power supply.

10. The LED traffic signal of claim 7, wherein the LED load comprises at least one LED mounted on a printed circuit board.

11. The LED traffic signal of claim 9, wherein the fuse blow out circuit comprises a switch adapted to create a short between an active and a neutral wire of the traffic signal.

12. The LED traffic signal of claim 9, wherein the safety circuit blows out a fuse to disable a switch if no current flows through the LED load after a predetermined time when the switch is activated and/or the light out detector circuit detects less than a predetermined threshold light output.

13. A power supply system for providing power to an LED traffic signal, the system comprising:

an LED load comprising at least one LED mounted on a printed circuit board;

a power supply module that receives an AC input voltage from an AC input line and transforms the AC input voltage into a DC voltage with a regulated current to power the LED load; and a synchronized power pulse circuit connected to the power supply module that generates a synchronized power pulse representing a power consumption substantially equivalent to that of a halogen or incandescent traffic signal, wherein the synchronized power pulse has a fixed phase angle with respect to the line voltage independent of the AC line frequency.

14. The system of claim 13, wherein the power supply further comprises: an input surge protection circuit, a fuse blow out circuit, an input EMI filter, a rectifier bridge, a safety circuit, a turn on / turn off circuit, an LED current detector circuit and a switching main power supply.

15. The system of claim 14, wherein the fuse blow out circuit comprises a switch adapted to create a short between an active and a neutral wire of the traffic signal.

16. The system of claim 14, wherein the safety circuit is operative to blow out a fuse to disable a switch if no current flows through the LED load after a predetermined time when the switch is activated and/or the light out detector circuit detects less than a predetermined threshold light output.

17. An LED traffic signal comprising:

a housing with an opening;

a printed circuit board coupled to the housing;

a power supply coupled to the printed circuit board, the power supply comprising:

a power supply module that receives an AC input voltage from an AC input line and transforms it into DC voltage with a regulated current to power an LED load comprising at least one LED mounted on a printed circuit board;

a synchronized power pulse circuit connected to the power supply module that generates a synchronized power pulse representing a power consumption substantially equivalent to that of a halogen or incandescent traffic signal.

18. The LED traffic signal of claim 17, wherein the synchronized power pulse has a fixed phase angle with respect to the line voltage independent of the AC line frequency.

19. The LED traffic signal of claim 17, wherein the power supply further comprises: an input surge protection circuit, a fuse blow out circuit, an input EMI filter, a rectifier bridge, a safety circuit, a turn on / turn off circuit, an LED current detector circuit and a switching main power supply.

20. The LED traffic signal of claim 19, wherein the fuse blow out circuit comprises a switch adapted to create a short between an active and a neutral wire of the traffic signal and the safety circuit blows out a fuse to disable a switch if no current flows through the LED load after a predetermined time when the switch is activated and/or the light out detector circuit detects less than a predetermined threshold light output.

* * * * *